US006262689B1

(12) United States Patent
Yamamoto et al.

(10) Patent No.: US 6,262,689 B1
(45) Date of Patent: Jul. 17, 2001

(54) ANTENNA FOR COMMUNICATING WITH LOW EARTH ORBIT SATELLITE

(75) Inventors: Osamu Yamamoto; Ryuichi Iwata, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/215,219

(22) Filed: Dec. 18, 1998

(30) Foreign Application Priority Data

Dec. 22, 1997 (JP) ..... 9-353210

(51) Int. Cl.[7] ..... H01Q 13/00

(52) U.S. Cl. ..... 343/781 P; 343/DIG. 2; 343/836

(58) Field of Search ..... 343/836, 781 P, 343/761, 781 R, 781 LA, 839, 840, 779, 781 CA, DIG. 2; H01R 13/00, 3/20

(56) References Cited

U.S. PATENT DOCUMENTS

| | | | | |
|---|---|---|---|---|
| 4,355,313 | * | 10/1982 | Hubert | 343/725 |
| 4,462,034 | * | 7/1984 | Betsudan et al. | 343/761 |
| 4,535,338 | * | 8/1985 | Ohm | 343/781 CA |
| 4,618,866 | * | 10/1986 | Makino et al. | 343/779 |
| 4,618,867 | * | 10/1986 | Gans | 343/781 P |
| 4,638,322 | | 1/1987 | Lamberty . | |
| 5,485,168 | * | 1/1996 | Parekh | 343/761 |
| 5,796,370 | * | 8/1998 | Courtonne et al. | 343/781 P |
| 6,032,041 | * | 2/2000 | Wainfan et al. | 455/427 |
| 6,061,562 | * | 5/2000 | Martin et al. | 455/431 |

FOREIGN PATENT DOCUMENTS

| | | |
|---|---|---|
| 0 426 566 A1 | 5/1991 | (EP) . |
| 0 597 318 A2 | 5/1994 | (EP) . |
| 2 596 208 | 9/1987 | (FR) . |
| 1-280271 | 11/1989 | (JP) . |
| 3-4603 | 1/1991 | (JP) . |
| 4-208891 | 7/1992 | (JP) . |

OTHER PUBLICATIONS

Japanese Office Action, dated Dec. 21, 1999, with English language translation of Japanese Examiner's comments.

Toshio Sato, "Guide to Maritime Satellite Communication", Institute of Electronics and Communication Engineers of Japan, Jul. 25, 1986.

* cited by examiner

*Primary Examiner*—Tho Phan
(74) *Attorney, Agent, or Firm*—McGuireWoods LLP

(57) ABSTRACT

The object of the present invention is to provide an antenna for communicating with a low earth orbit (LEO) satellite which is small-sized and light and can track a LEO satellite at high speed at a small-sized earth station using a LEO satellite. The antenna according to the present invention uses two offset parabolic antenna-type reflectors and each primary feed is installed in the focal position of a paraboloid forming the reflector. The quantity of an offset of the offset parabolic antenna is selected so that antenna gain is maximum at the minimum operational elevation angle. Each primary feed is mechanically independent of the mobile reflector, is attached and fixed to a feed line. In the meantime, each reflector is turned based upon an azimuth axis and an elevation axis according to Az-EL mounting.

13 Claims, 14 Drawing Sheets

ANTENNA FOR COMMUNICATING WITH LOW EARTH ORBIT SATELLITE

BACKGROUND OF THE INVENTION

1. Field of the Invention

The present invention relates to an antenna for communicating with a low earth orbit satellite, particularly relates to an antenna for communicating with a low earth orbit satellite used for an earth station in a satellite communication system in which plural low earth orbit (LEO) satellites revolve around the earth for automatically tracking each satellite.

2. Description of the Related Art

Recently, a scheme that high-speed data at approximately a few Mbps to a few tens Mbps is provided to users all over the world using a high-frequency signal in Ka band (20 to 30 GHz) via multiple LEO satellites is formed.

In such a satellite communication system using multiple LEO satellites, as each satellite goes off a visual field in relatively short time when viewed from a small-sized earth station, it is required to be tracked in a large range.

Heretofore, for an antenna for tracking a satellite, plural techniques are widely known as the antenna of an earth station for a geostationary satellite and a mobile satellite.

For example, for a method of tracking, a monopulse tracking method of continuously detecting whether an antenna tracks a satellite in the center of a beam or not and controlling so that an antenna bearing is always equal to the bearing of a satellite, a step tracking method of shifting an antenna at a fixed interval of time by degrees and adjusting it in a bearing in which a receiving level is maximum and a program tracking method of changing the bearing of an antenna based upon the estimated information of a satellite orbit are known.

For a method of supporting a mobile antenna, Az-EL mounting in which the azimuth angle and the elevation angle of the mobile antenna are shifted and XY mounting which the mobile antenna is shifted in a direction perpendicular to a satellite orbital direction are widely known. The Az-EL mounting is currently the most adopted method, one axis (the azimuth axis) is arranged perpendicularly to the ground and the other axis (the elevation axis) is arranged horizontally. In the XY mounting, the x-axis horizontal with the ground is perpendicular to the y-axis and the y-axis is turned together with the x-axis. The XY mounting is suitable for tracking a LEO satellite which moves near the zenith at high speed, however, as both axes are located in high positions from the ground, the XY mounting has a mechanical defect.

Next, referring to the drawings, the satellite tracking technique of an antenna of a conventional type concrete earth station will be described.

FIG. 13 shows the constitution of a conventional type antenna of an earth station for tracking a satellite. FIG. 13 shows an example of a large-sized antenna of an earth station for tracking a satellite and the main reflector is Cassegrainian antenna 13 m in diameter. The antenna tracks a satellite using a driving mechanism according to Az-EL mounting, and both the azimuth axis and the elevation axis are driven by a jackscrew driving mechanism. To simplify structure, the driving mechanism is allowed to continuously drive only within a range of ±10° in the direction of an azimuth and a limited driving method that when an antenna is required to be directed at a larger angle in another direction, a set screw is loosened and the antenna is turned slowly is adopted. For the elevation axis, continuous driving between 0° and 90° is enabled. A primary feed is attached to the main reflector and is integrally driven with the main reflector.

FIG. 14 shows another conventional type antenna of an earth station for tracking a satellite and a small-sized antenna of an earth station for tacking a satellite in which miniaturization and lightening are realized though an aperture antenna is used as the above large-sized antenna is known.

FIG. 14 shows a parabolic antenna used for a ship earth station according to International Maritime Satellite Organization (INMARSAT) standard A, and a cross dipole and a reflector are located in the focus of a reflector with a paraboloid as a primary feed. In the antenna, the reflector and the feed are also integrated. To track a satellite, the above parabolic antenna is driven using four-axes mounting obtained by combining the above Az-EL mounting and XY mounting.

The above technique is described in "Guide to maritime satellite communication" written by Mr. Toshio Sato and published on Jul. 25, 1986 by Institute of Electronics and Communication Engineers of Japan.

As described above, technique for tracking a satellite used for the conventional type antenna for satellite communication can be effectively applied to a case in which a tracking range is relatively small as a geostationary satellite, however, the above conventional type antenna is not suitable for the above antenna for tracking and communicating with a LEO satellite for the following reasons:

That is, in the conventional type antenna for satellite communication, as the primary feed and the reflector are integrated and turn an antenna in tracking a satellite, the antenna to be turned is heavy, a driving system is also large-sized, high-speed tracking is difficult and the area of a radome for housing the antenna is also increased. In a satellite communication system using LEO satellites, considering that multiple small-sized earth stations are installed in each home and others, the size of the whole antenna is required to be as small-sized as possible and as light as possible, and miniaturization and lightening are a large problem.

Further, as the primary feed and the reflector are integrated and turn an antenna, a feeding system is required to be provided so that a radio frequency (RF) sending/receiving part such as a low noise amplifier and a high-frequency power amplifier is also mounted near the primary feed so as to stably feed to the primary feed also during turning, however, in this case, the weight of the antenna is also increased by the weight of the RF sending/receiving part.

In this case, it is also conceivable that the RF sending/receiving part is separated from the reflector and fixed, however, to maintain stable connection independent of the displacement by turning of the feeding part, an electric supply line is required to be flexible, a rotary joint and others are required to be used and there is a problem that an antenna for satellite communication is complicated and high-priced.

When a satellite being tracked in a certain orbit disappears from the north to the south because LEO satellites revolve in plural orbits, another satellite revolving in the same orbit is required to be tracked next. In this case, information communicated using the former satellite is required to be communicated using the latter satellite and hand over for instantaneously switching to the latter satellite is required.

However, the above conventional type technique has a problem that it is difficult to provide hand over for switching to another satellite in the same orbit.

SUMMARY OF THE INVENTION

As described above, the object of the present invention is to provide an antenna for communicating with a low earth orbit satellite used for a small-sized earth station for communicating with multiple LEO satellites, which is small-sized and light, tracks a LEO satellite at high speed and further, is provided with hand over.

To achieve the above object, an antenna for communicating with a low earth orbit satellite according to the present invention is based upon an antenna for communicating with a low earth orbit satellite used on the side of the ground in a satellite communication system using low earth orbit satellites and is characterized in that the above antenna mechanically tracks the above low earth orbit satellite using two offset aperture antennas (offset antennas) separated by predetermined distance. The above antenna according to the present invention is characterized in that it mechanically tracks a low earth orbit satellite by fixing the respective primary feeds of the above two aperture antennas and turning only the respective reflectors of the two aperture antennas based upon an azimuth axis and an elevation axis in a direction of a low earth orbit satellite. The above antenna according to the present invention is characterized in that an antenna feed line for respectively feeding the above two aperture antennas and an RF sending/receiving part connected to the above antenna feeding part for sending or receiving a high-frequency signal by switching the above antenna feed lines are further provided. The above antenna feeding part and the RF sending/receiving part are characterized in that they are both mounted between the above two aperture antennas.

Further, concretely, the antenna for communicating with a low earth orbit satellite according to the present invention is based upon an antenna for communicating with a low earth orbit satellite used on the side of the ground in a satellite communication system using low earth orbit satellites and is characterized in that two reflectors the respective centers of which are separated by predetermined distance and which respectively have a predetermined offset paraboloid, two Az-EL mounts respectively connected to the above reflectors for turning the respective reflectors based upon an azimuth axis and an elevation axis and tracking a low earth orbit satellite, two primary feeds for radiating predetermined beams to the respective reflectors, two feed lines for respectively feeding to the above primary feeds and respectively supporting the primary feeds so that each primary feed can be fixed independently of the reflectors and an RF sending/receiving part connected to the above feed lines for sending or receiving a high-frequency signal by selecting either are provided.

The above antenna according to the present invention is characterized in that the value of the above offset is set so that antenna gain is maximum at a predetermined minimum operational elevation angle.

The above antenna according to the present invention is also characterized in that the above predetermined minimum operational elevation angle is the limit of tracking in the direction of the elevation angle of the above low earth orbit satellite and is determined based upon the altitude of the above low earth orbit satellite and the number of satellites arranged in the same orbit.

Any of an offset parabolic antenna, an offset Cassegrainian antenna and an offset Gregorian antenna is used for the above antenna.

The above azimuth axis is an axis turned around a straight line connecting the center of the above reflector and the center of the above primary feed and the above elevation axis is an axis which is in contact with a line perpendicular to a radial straight line passing the paraboloid of an offset reflector from an intersection point (the center) of the axis of the paraboloid and the paraboloid on the paraboloid.

DETAILED DESCRIPTION OF THE PREFERRED EMBODIMENTS

Figure 1:
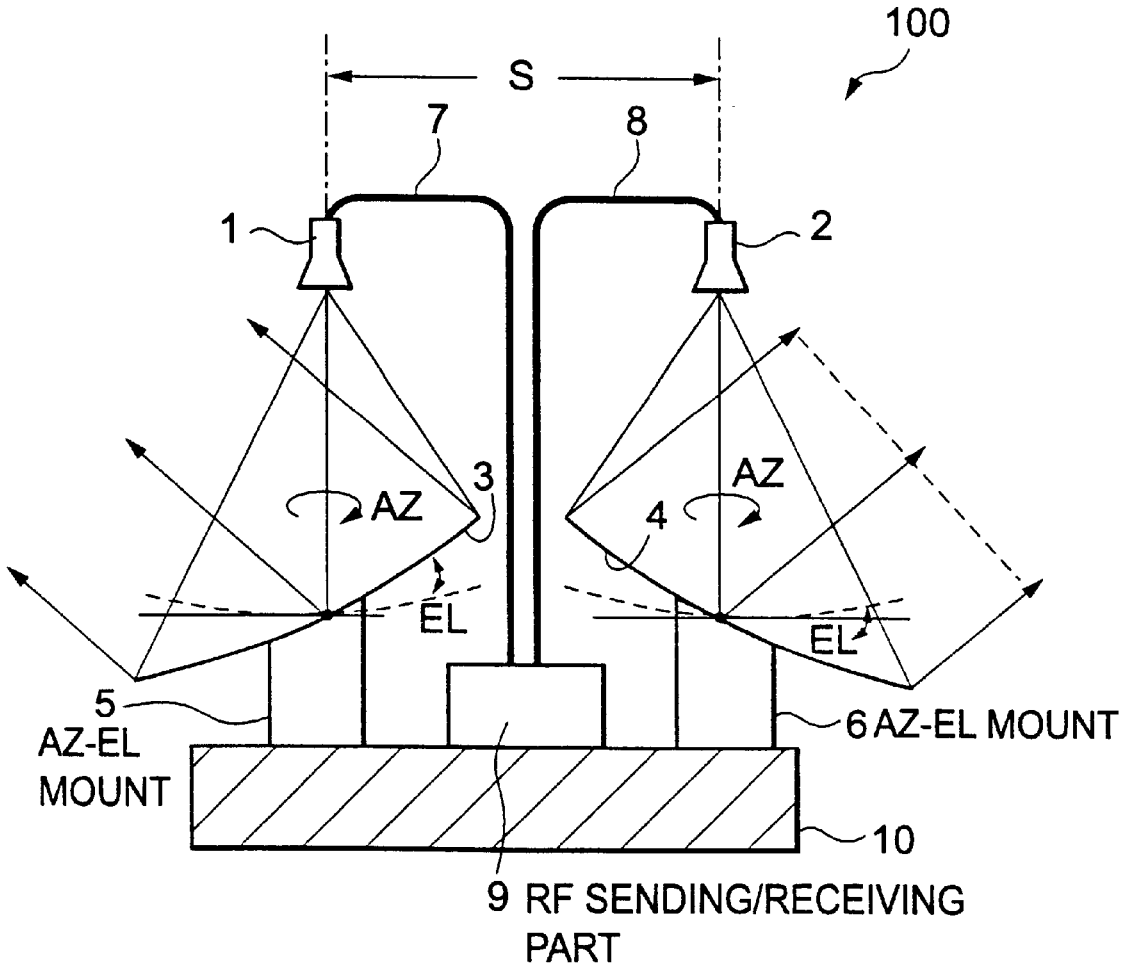
FIG. 1 shows the constitution of an offset parabolic antenna for communicating with a low earth orbit satellite equivalent to a first embodiment of the present invention.

Next, referring to the drawings, a first embodiment of the present invention will be described in detail. FIG. 1 shows the constitution of an antenna for communicating with a low earth orbit satellite according to the present invention.

As shown in FIG. 1, an antenna for communicating with a low earth orbit satellite 100 according to the present invention is provided with two aperture antennas respectively mainly composed of a fixed primary feed and a mobile offset reflector. The reason why the two aperture antennas are used is that two satellites in the same orbit are required to be tracked and handed over in a system using low earth orbit satellites though the details are described later.

A first aperture antenna is composed of a primary feed (horn) 1 for sending or receiving a signal mainly in Ka band, an offset reflector 3 provided with a predetermined paraboloid, an Az-EL mount 5 connected to the reflector 3 for turning an azimuth axis and an elevation axis and tracking a satellite and a feed line 7 for feeding to the primary feed 1. A second aperture antenna is composed of a primary feed (horn) 2 for sending or receiving a signal mainly in Ka band, an offset reflector 4 provided with a predetermined paraboloid, an Az-EL mount 6 connected to the reflector 4 for turning an azimuth axis and an elevation axis and tracking a satellite and a feed line 8 for feeding the primary feed 2.

The primary feeds 1 and 2 are respectively fixed using the feed lines 7 and 8 and distance between the centers of both feeds is a fixed value D.

Further, the feed lines 7 and 8 are connected to an RF sending/receiving part 9 composed of a low noise amplifier and a high-frequency power amplifier, either of both feed lines is selected and a high-frequency signal is sent or received.

It is desirable that these feed lines 7 and 8 and the RF sending/receiving part 9 are mounted in a position between two aperture antennas to miniaturize the whole antenna and reduce loss in feeding.

The whole antenna is fixed on a supporting part 10.

Next, the constitution shown in FIG. 1 will be described.

The primary feed 1 is installed in the focal position of a paraboloid forming the reflector 3. The offset quantity of the offset parabolic antenna is selected so that antenna gain is maximum at the minimum operational elevation angle described later. The primary feed 1 has constitution mechanically independent of the reflector 3 with mobile structure, is attached to the feed line 7 and fixed.

Similarly, the primary feed 2 is installed in the focal position of a paraboloid forming the reflector 4 in a position separated by distance S from the center of the primary feed 1. The offset quantity of the offset parabolic antenna is selected so that antenna gain is maximum at the minimum operational elevation angle described later. The primary feed 2 has constitution mechanically independent of the reflector 4 with mobile structure, is attached to the feed line 8 and fixed.

As described above, the feed lines 7 and 8 are also provided with a function for respectively supporting the primary feeds 1 and 2 in addition to a feeding function. It is because the feed lines 7 and 8 can be fixed relatively easily without using a special supporting mechanism for respectively fixing the primary feeds 1 and 2 because the feed lines are respectively constituted by a waveguide.

Although the primary feeds 1 and 2 are fixed, the reflectors 3 and 4 are respectively provided with structure turned based upon the azimuth axis and the elevation axis by the Az-EL mounts 5 and 6.

The primary feeds 1 and 2 are connected to the RF sending/receiving part 9 respectively via the feed lines 7 and 8 connected to the primary feeds. It is desirable to reduce loss in feeding that the RF sending/receiving part 9 is installed near the primary feeds 1 and 2.

Figure 2:
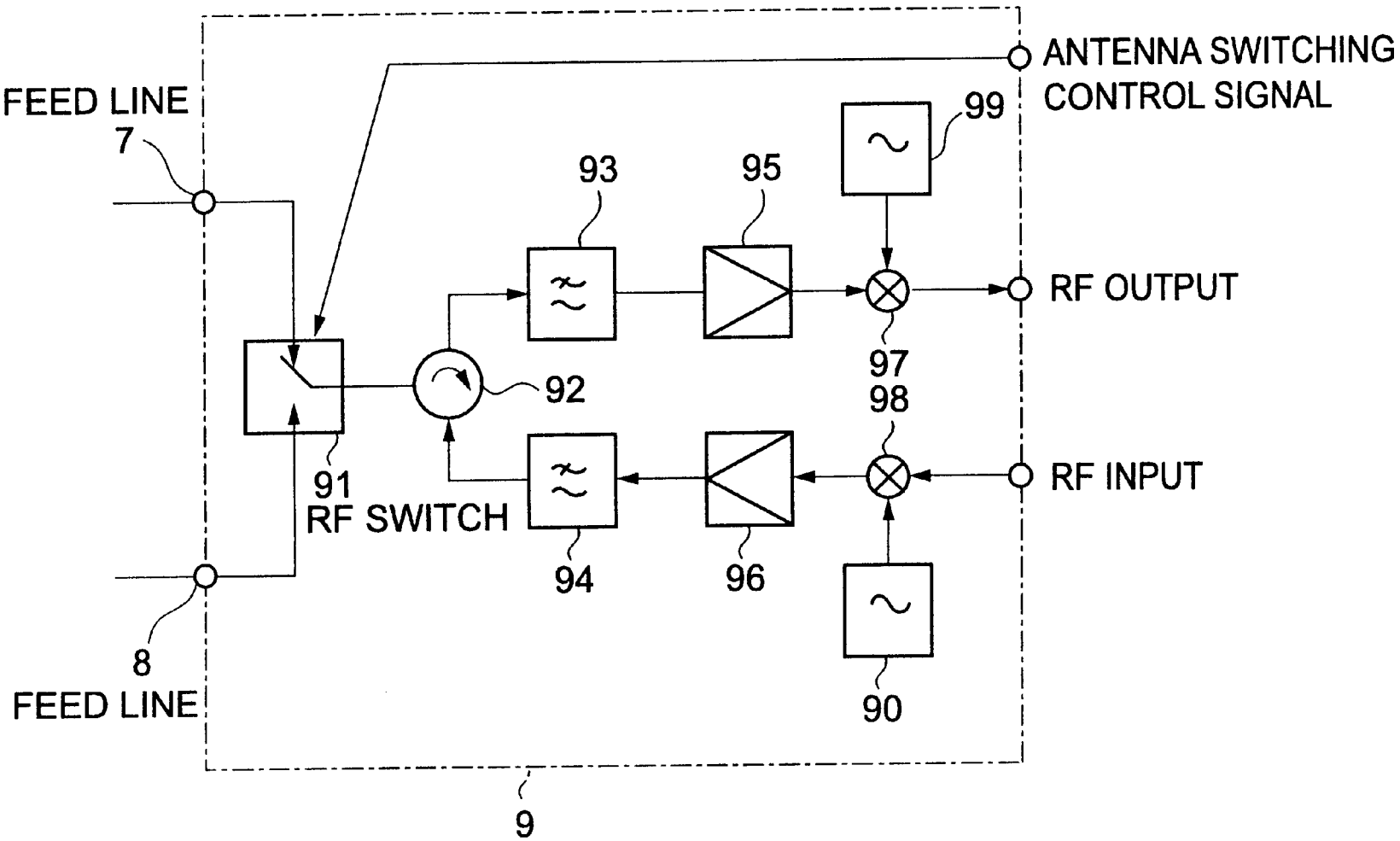
FIG. 2 is a block diagram showing the concrete configuration of an RF sending/receiving part shown in FIG. 1.

FIG. 2 shows the configuration of the RF sending/receiving part 9. As shown in FIG. 2, the feed lines 7 and 8 are connected to the RF sending/receiving part 9 and either is selected by an RF switch 91 according to an antenna switching control signal. A diplexer 92 is connected to the output of the RF switch 91 to separate a sent signal and a received signal. That is, for a sent signal, a sent signal input via the RF switch is amplified by a power amplifier 96 after the sent signal is converted to a required high frequency in Ka band by a sending local section 90 and a sending mixer 98 and is input to the diplexer 92 via a lowpass filter 94. In the meantime, output from the diplexer 92 is input to the low noise amplifier 95 via the lowpass filter 93, is converted to a high frequency by a receiving mixer 97 and a receiving local section 99 and high-frequency output can be obtained.

Figure 3B:
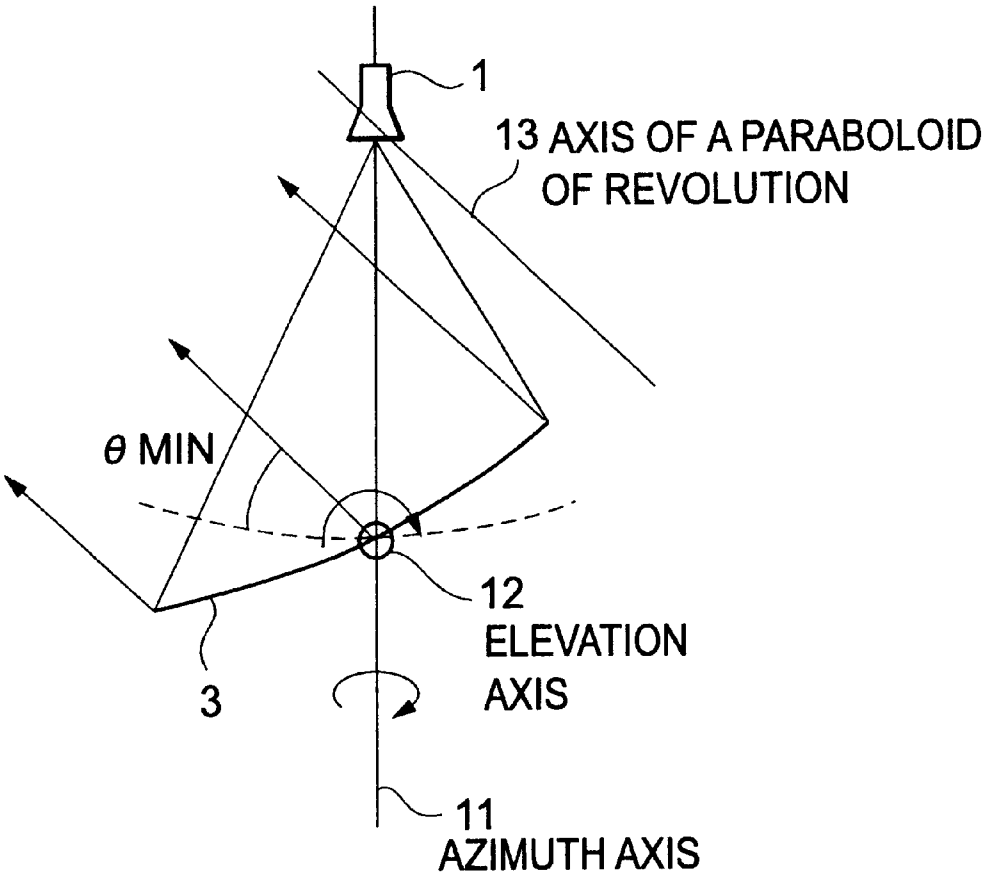
FIGS. 3A and 3B show the concrete constitution of an offset antenna reflector shown in FIG. 1.
Figure 3A:
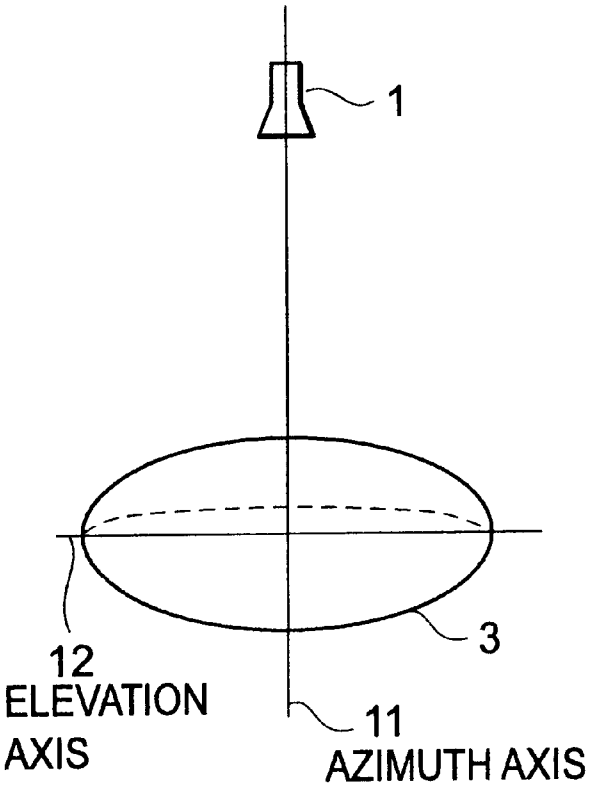

FIGS. 3A and 3B explain the tracking mechanism of this antenna and particularly shows the reflector 3 and the primary feed 1 respectively related to tracking. Offset antennas with parabolic reflectors are both used for the first and second aperture antennas of this antenna. As each of the offset antennas with parabolic reflectors has common structure, it is described only using the primary feed 1 and the reflector 3, however, the combination of the primary feed 2 and the reflector 4 is constituted similarly.

FIG. 3A shows the reflector 3 and the primary feed 1 viewed from a front, a full line shows the position of the reflector 3 at the minimum operational elevation angle $\theta$ MIN and a dotted line shows the position of the reflector 3 in case an elevation angle is approximately 90°. FIG. 3B shows the reflector 3 and the primary feed 1 respectively viewed from the side. As also clear from these drawings, an azimuth axis 11 is turned around a straight line connecting the center of the reflector 3 and the center of the primary feed 1 and the reflector 3 is turned 360° with the azimuth axis 11 in the center. A reference number 13 denotes the axis of a paraboloid.

Figures 4A, 4B:
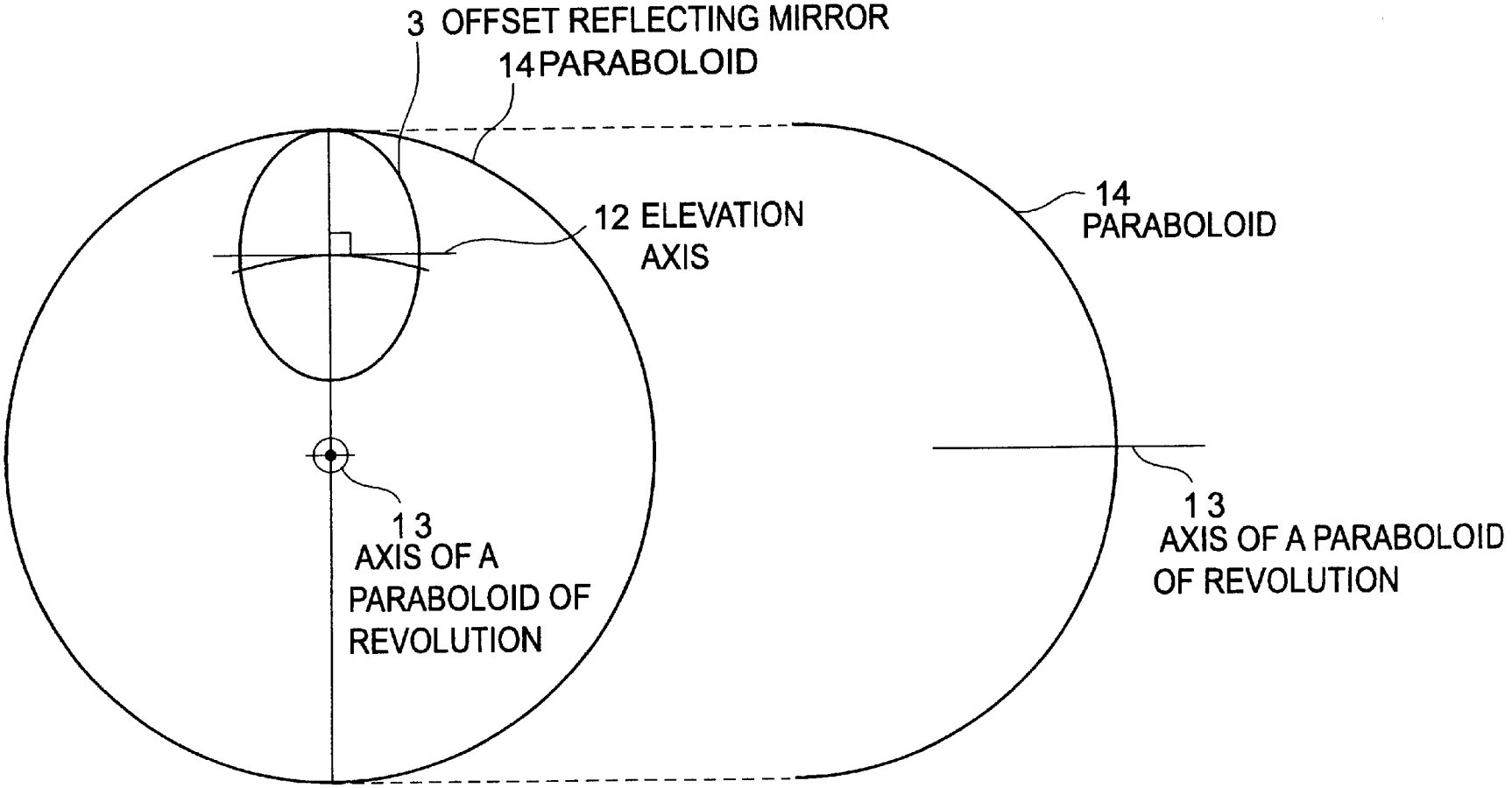
FIGS. 4A and 4B explain the definition of an elevation axis shown in FIG. 3.

In the meantime, FIG. 4 explain an elevation axis 12 and the elevation axis 12 in these drawings means an axis which is in contact with a line perpendicular on a paraboloid to a radial straight line passing the paraboloid of the offset reflector 3 from an intersection point (the center) of the axis 13 of the paraboloid and a paraboloid 14. An angle varies between the minimum operational elevation angle and 90° with the elevation axis in the center.

The Az-EL mount 5 drives the reflector 3 so that the reflector 3 is turned around the azimuth axis 11 and the elevation axis 12 to track a satellite.

Therefore, the primary feed 1 is always fixed in the focal position of the paraboloid even if the reflector 3 is turned because the primary feed is fixed by the supporting part 10.

As described above, the antenna for communicating with a low earth orbit satellite according to the present invention turns the reflectors 3 and 4 around the azimuth axis and can track a satellite in the omnibearing. The elevation angle showing directivity can be varied by turning the reflectors 3 and 4 around the elevation axis and directivity in the direction of the zenith at which the elevation angle is 90° can be obtained.

Next, a required range of tracking angles of the above antenna for communicating with a low earth orbit satellite will be described.

Figure 5:
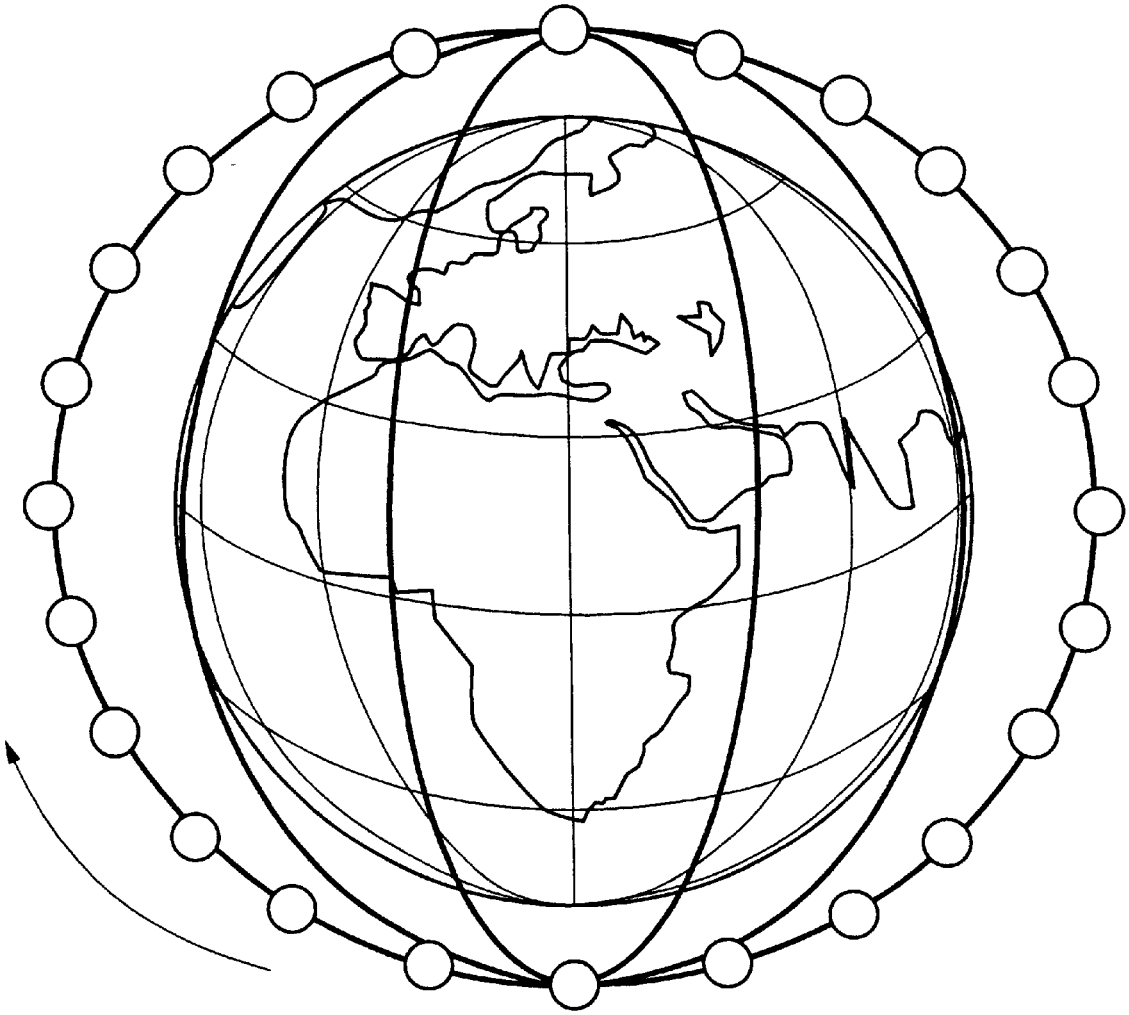
FIG. 5 is an imaginative drawing showing a LEO satellite.

FIG. 5 is an imaginative drawing showing that multiple LEO satellites are arranged on plural orbital planes over the earth to cover the whole world. As shown in FIG. 5, a satellite communication system for covering the whole world is provided by arranging multiple LEO satellites over the earth so that any satellite can be seen in any place on the earth.

A LEO satellite means a satellite on an elliptical orbit including a circular orbit at the altitude of approximately 1500 km over the ground or less and assuming that the orbital period of each satellite is 1000 km at altitude, each satellite revolves over the earth in approximately one hour and forty-five minutes.

Assuming that the altitude of a satellite is 765 km and the minimum operational elevation angle is 30°, the number of satellites to be arranged on the same orbital plane is 20 and ten orbital planes are required to cover the whole world. That is, the total number of required satellites is 200. The number of the required satellites is determined based upon the altitude and the minimum operational elevation angle of satellites and even if satellites are at the same altitude, the number of required satellites is 98 if the operational elevation angle is 20° and the number of required satellites is 45 if the operational elevation angle is 10°.

Figure 6:
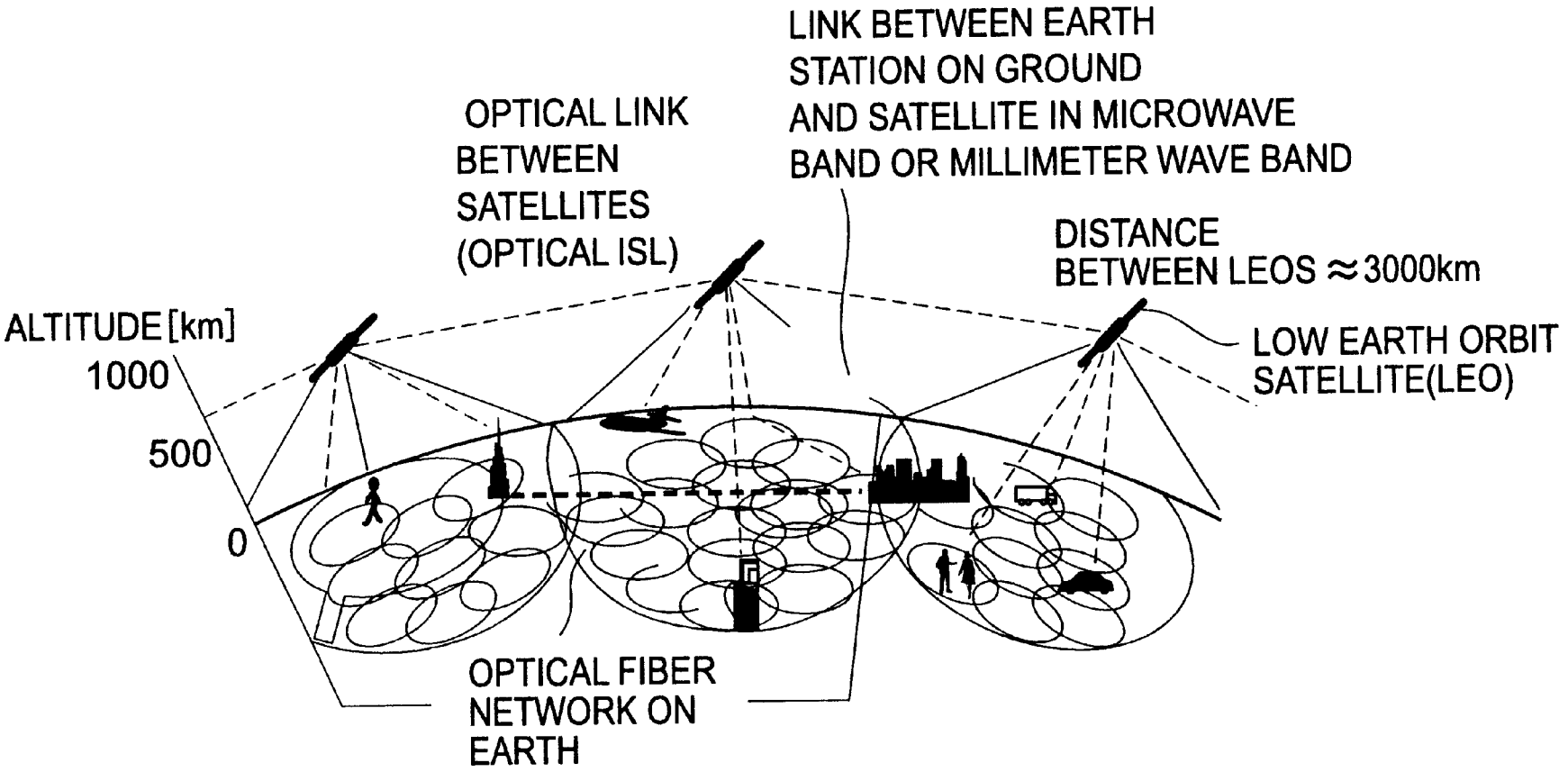
FIG. 6 shows as a satellite communication system using a LEO satellite.

FIG. 6 is a conceptual drawing showing a wide-band satellite communication system provided using LEO satellites. As shown in FIG. 6, in this system, a low-speed channel of approximately 64 kbps using multi-beams in L band (1.5 to 1.6 GHz) is provided to a small-sized user such as a portable terminal and high speed data is provided to a large-sized user such as a ship, an airplane and a small-scale office using multiple spot beams in Ka band (generally called a quasi-millimeter wave band and 20 to 30 GHz) at a small-sized earth station.

The present invention relates to the antenna for communicating with a low earth orbit satellite used at a small-sized earth station mainly for the latter user of high-speed data.

Figure 7:
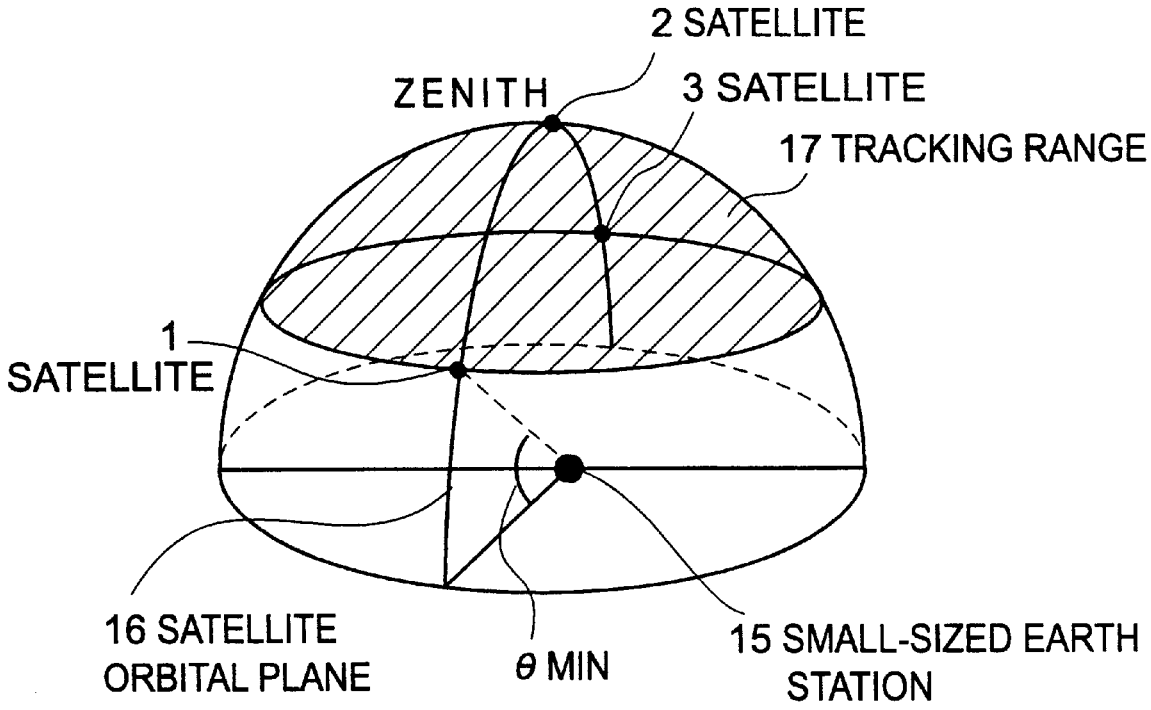
FIG. 7 shows a tracking range according to the present invention.

FIG. 7 shows a satellite tracking range in case a LEO satellite provided with an orbital plane 16 (FIG. 7 shows only three LEO satellites 1, 2 and 3 to simplify) is viewed from a small-sized earth station 15 on the ground mounting the antenna for communicating with a low earth orbit satellite according to the present invention. As shown in FIG. 7, the minimum operational elevation angle θ MIN is determined based upon relationship between the number of LEO satellites and altitude as described above and the satellite tracking range 12 is equivalent to an area shown by an oblique line, that is, the whole area in the omnibearing from the minimum operational elevation angle θ MIN to the zenith. Also, as shown in FIG. 7, for the state of the satellites 1, 2 and 3 in the satellite tracking range 17, the satellite 1 moves from inside the tracking range to outside the tracking range, the satellite 2 exists in the zenith and the satellite 3 moves from outside the tracking range to inside the tracking range. For example for the two aperture antennas of this antenna, the first aperture antenna tracks the satellite 1 and the second aperture antenna tracks the satellite 2. The RF switch 91 selects the side of the satellite 1. Afterward, simultaneously when the satellite 1 moves outside the tracking range, the RF switch 91 selects the side of the satellite 2 and the first aperture antenna tracks the satellite 3 in place of the satellite 1.

As described above, hand over is realized by tracking a revolving satellite, alternately selecting the two aperture antennas.

Figure 8:
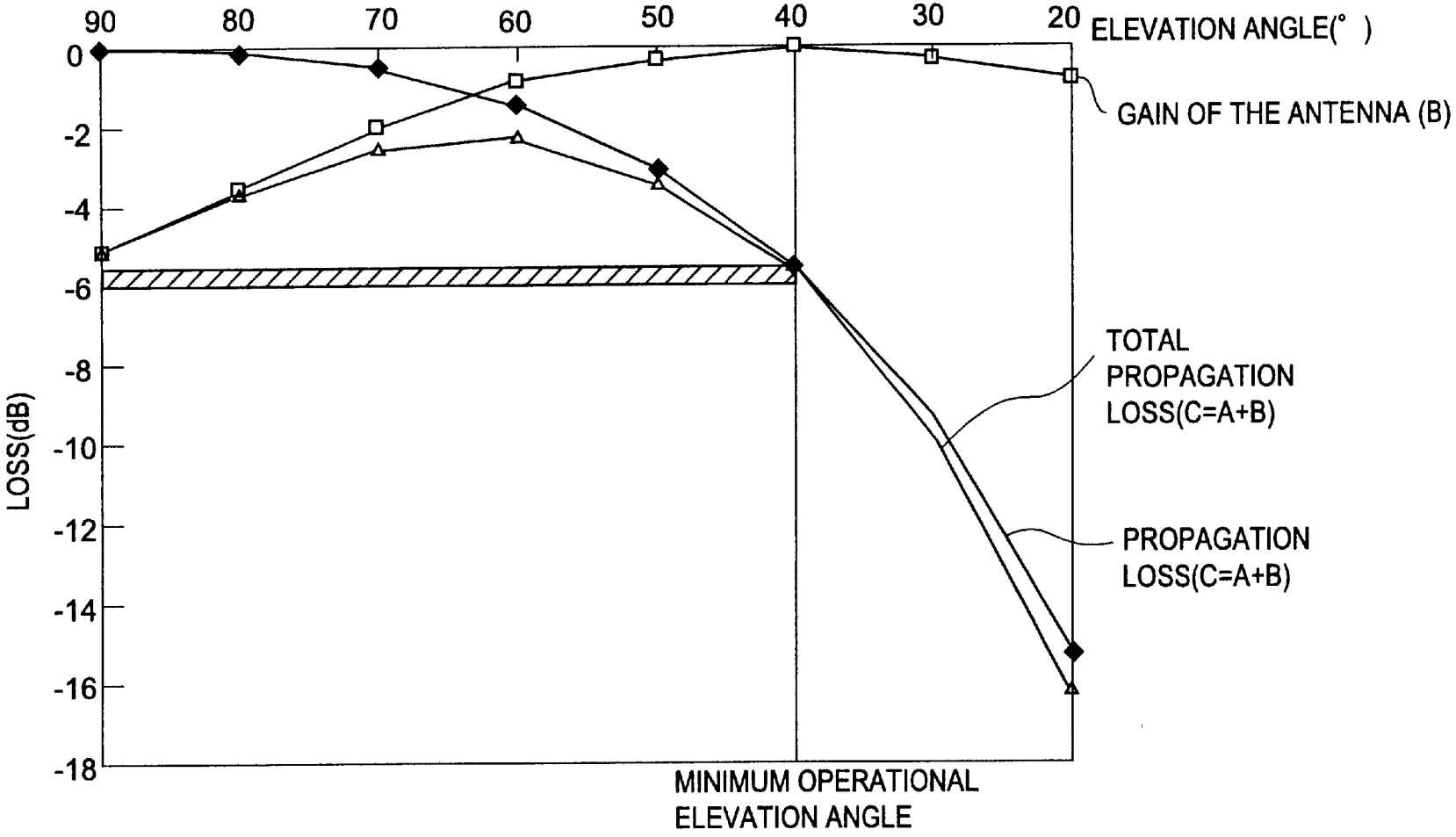
FIG. 8 shows relationship among propagation loss between a pair of elevation angles, antenna gain and the whole propagation loss.

Next, FIG. 8 shows relationship between propagation loss (A) composed of free-space loss based upon an elevation angle and loss due to attenuation by rainfall and the gain of the offset parabolic antenna (B). FIG. 8 also shows the sum of propagation loss (A) and the gain of the antenna (B), that is, the total propagation loss (C=A+B) including antenna gain. In FIG. 8, the minimum operational elevation angle θ MIN is set to 40°. The quantity of an offset is adjusted so that antenna gain is maximum at the elevation angle and propagation loss is calculated using a sending frequency 30 GHz in Ka band.

FIG. 8 shows that as a result, the total propagation loss is the largest at the minimum operational elevation angle 40° and as an elevation angle approaches the zenith, the total propagation loss decreases.

The reason is that directional gain in the direction of the zenith is low because it is off from the ideal condition of an offset parabolic reflector, however, in satellite communication in a microwave band, a millimeter wave band and others, antenna gain is required because a satellite is the farthest, free-space loss is increased, distance passing a rain-fall area is the longest and the quantity of attenuation by rainfall is the most when an elevation angle is small, while in the direction of the zenith, the above attenuation is the least.

Therefore, problems can be really decreased by setting a suitable value as the minimum operational elevation angle even if an elevation angle is set to a direction of the zenith.

Figure 9:
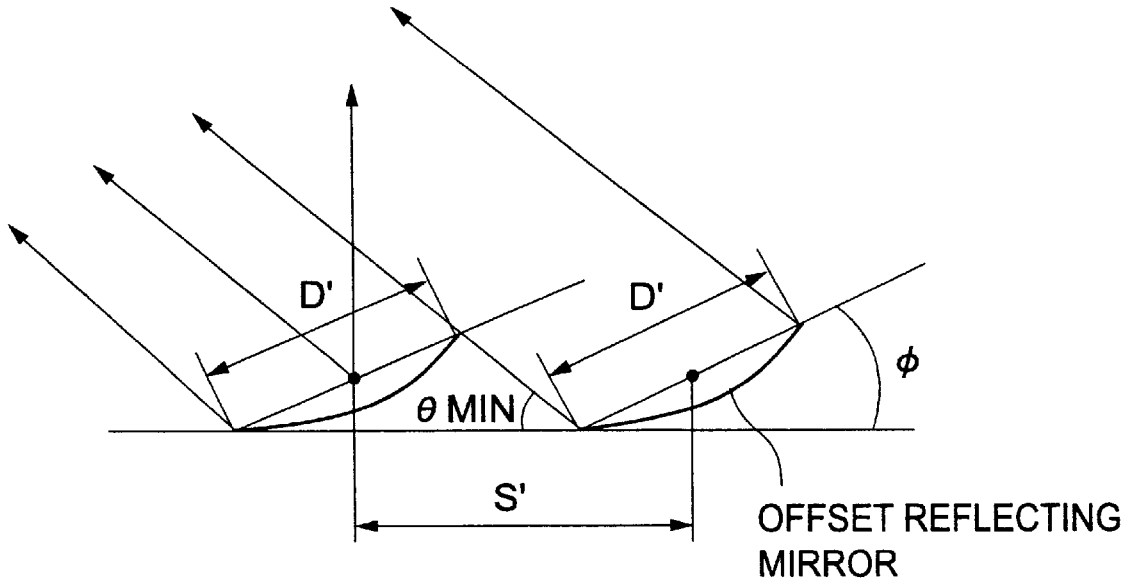
FIG. 9 shows distance between two antennas according to the present invention.

Next, referring to FIG. 9, large distance S between the two aperture antennas which has an effect upon the size of the antenna according to the present invention will be described. FIG. 9 shows a case that the two aperture antennas according to the present invention are arranged in parallel. "D" denotes a diameter of the offset reflector and to simplify, each diameter of the two aperture antennas is set to the same value. An angle ϕ denotes an angle between the reflector and a horizontal plane.

In a case shown in (1), the minimum value of distance S between the centers of the two reflectors as shown in FIG. 9 under a condition on which blocking is not caused is as shown in (2).

$$\phi=(90^\circ-\theta\mathrm{MIN})/2 \quad (1)$$

$$S=D\ (\cos\theta+\sin\theta/\tan\theta\mathrm{MIN}) \quad (2)$$

The first embodiment of the present invention using the offset parabolic antenna is described above, however, the present invention is not limited to such an antenna provided with a single reflector.

Figure 10:
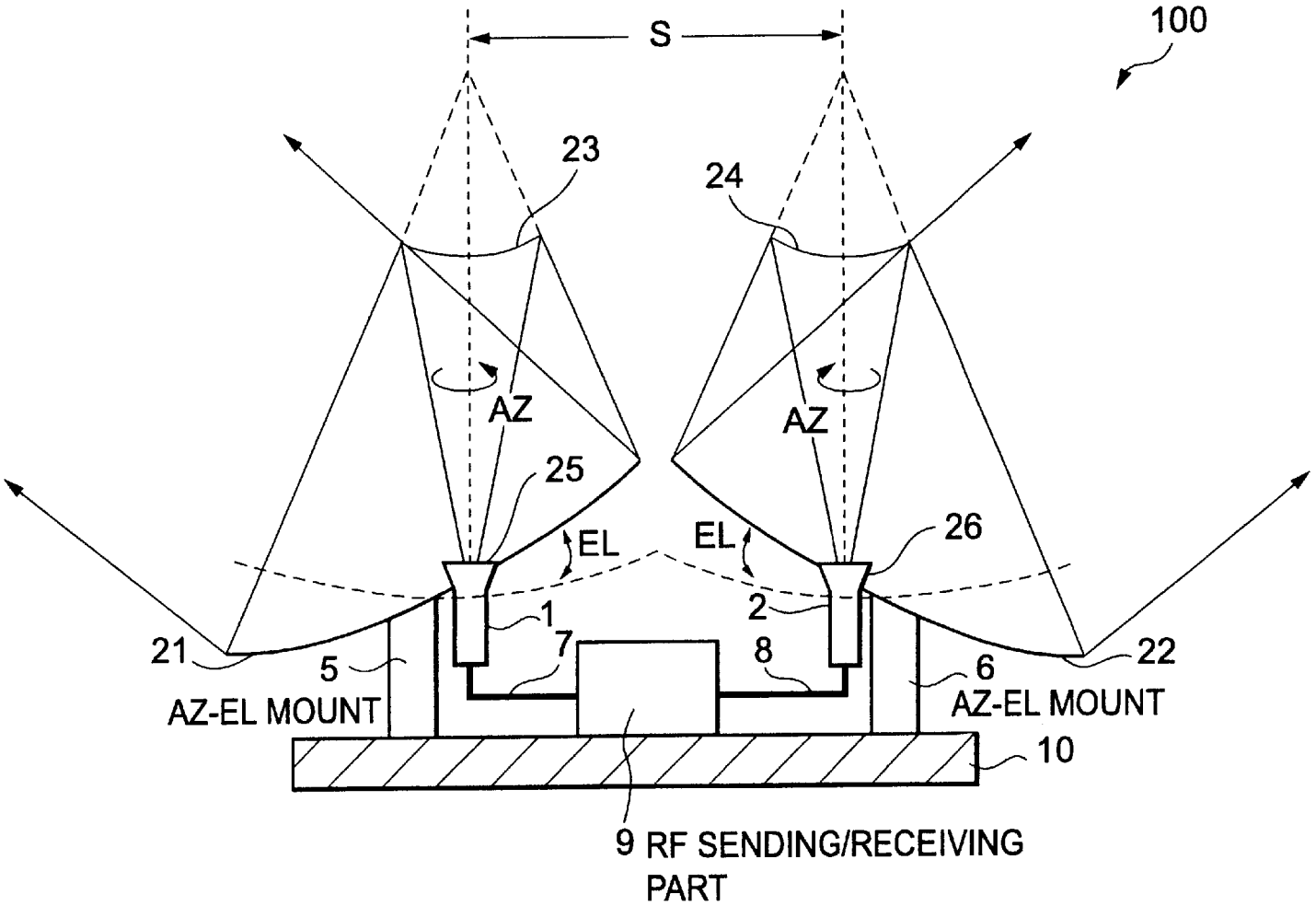
FIG. 10 shows the constitution of an offset Cassegrainian antenna for communicating with a low earth orbit satellite equivalent to a second embodiment of the present invention.

That is, for a second embodiment of the present invention, an offset Cassegrainian antenna provided with plural reflectors shown in FIG. 10 may be also used.

As shown in FIG. 10, reference numbers 21 and 22 respectively denote a main reflector having a paraboloid and as described above, a predetermined offset is applied to the main reflector so that the maximum antenna gain is obtained at the minimum operational elevation angle. Reference numbers 23 and 24 respectively denote a deputy reflector formed by a hyperboloid of revolution sharing the focus of a paraboloid as one focus. As another focus of the hyperboloid of revolution is located in each area of the main reflectors 21 and 22, circular holes 25 and 26 for radiating beams from primary feeds 1 and 2 are respectively provided to the main reflectors 21 and 22. As the other reference numbers are similar to those shown in FIG. 1, the description is omitted.

In this embodiment, as an antenna provided with plural reflectors is adopted as each offset antenna, the structure of the antenna is complicated, however, effect that loss in feeding is reduced, connection to a sending/receiving part is facilitated and blocking in a tracking range is prevented is produced because the primary feeds 1 and 2 respectively feed from the rear surface of the main reflectors 21 and 22.

Figure 11:
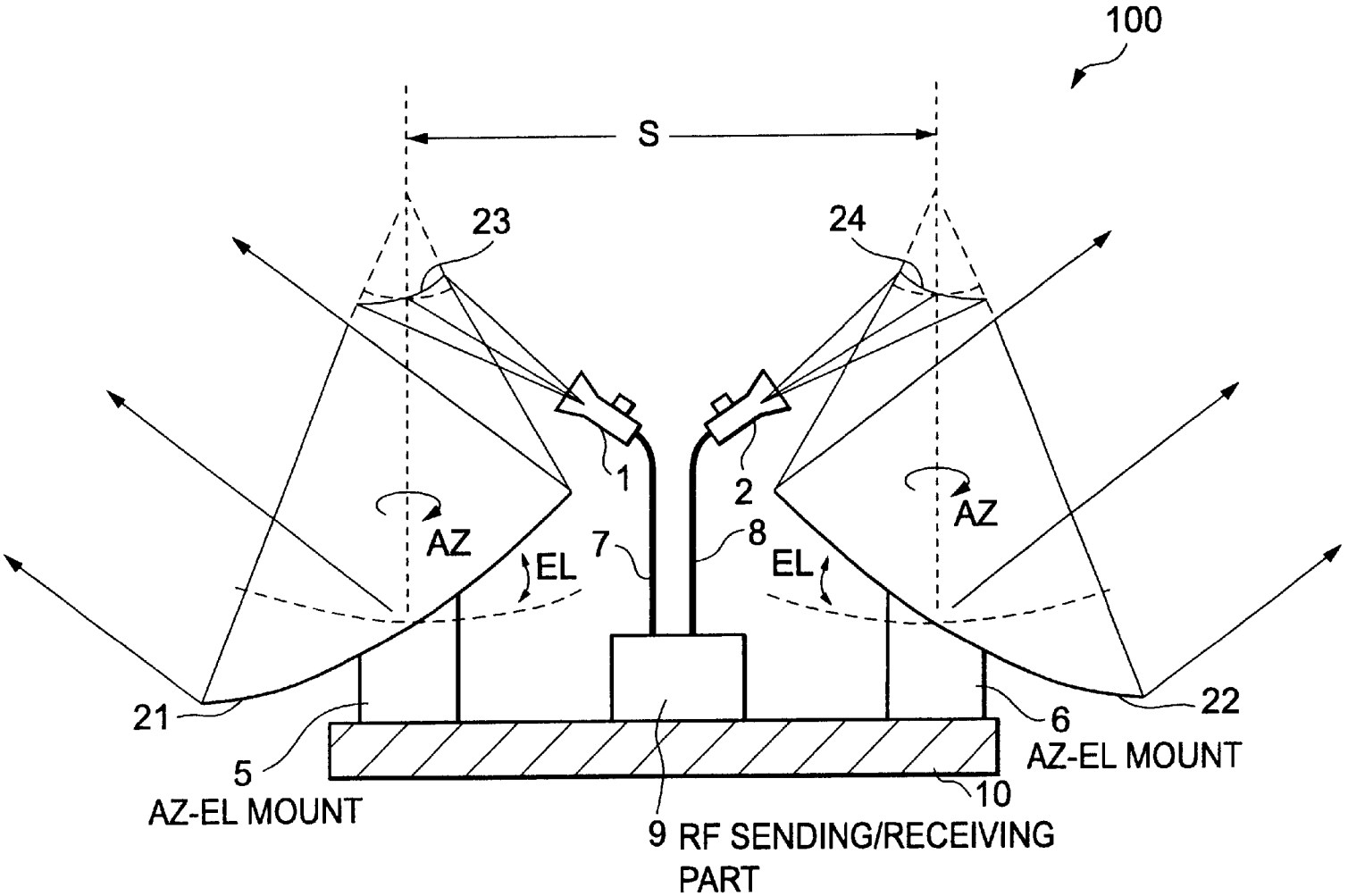
FIG. 11 shows the constitution of an offset Cassegrainian antenna for communicating with a low earth orbit satellite equivalent to a third embodiment of the present invention.

Further, for a third embodiment of the present invention, anther type offset Cassegrainian antenna provided with plural reflectors shown in FIG. 11 may be also used. In this embodiment, the offset Cassegrainian antenna provided with plural reflectors shown in FIG. 10 is also used, however, this embodiment is different from the second embodiment in that each position of primary feeds 1 and 2 is outside each area of main reflectors 21 and 22.

Figure 12:
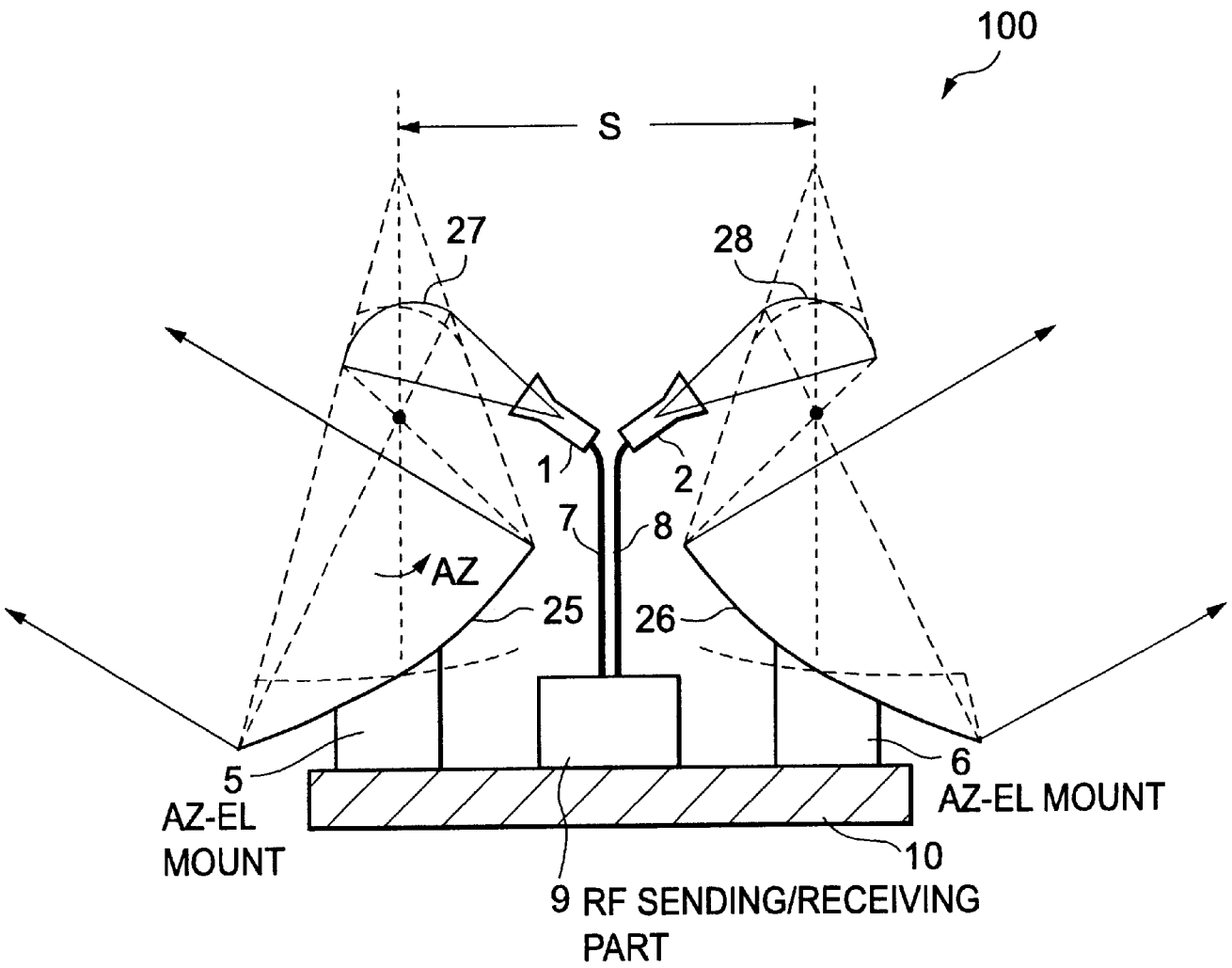
FIG. 12 shows the constitution of an offset Gregorian type antenna for communicating with a low earth orbit satellite equivalent to the third embodiment of the present invention.
Figure 13:
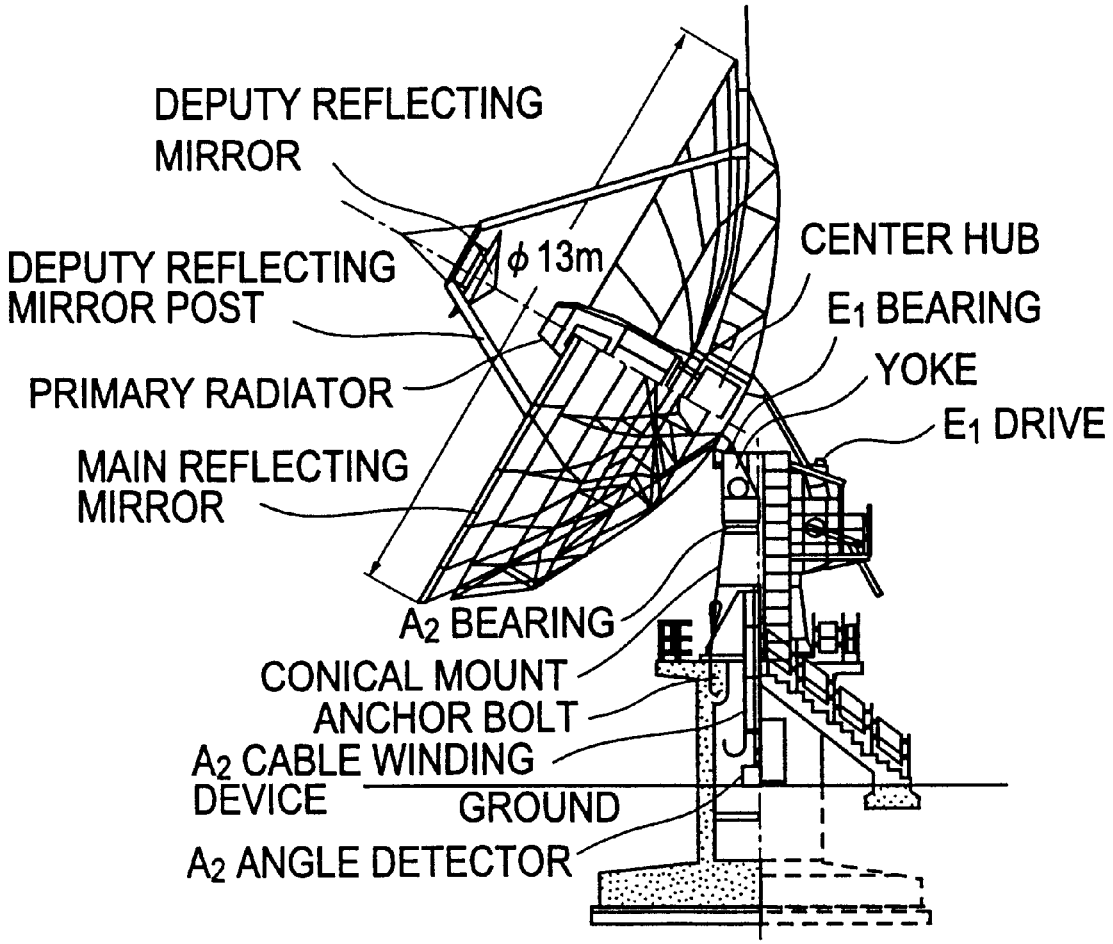
Fig.13 PRIOR ART
FIG. 13 is an outside drawing showing the antenna tracking technique of a conventional type large-sized earth station.
Figure 14:
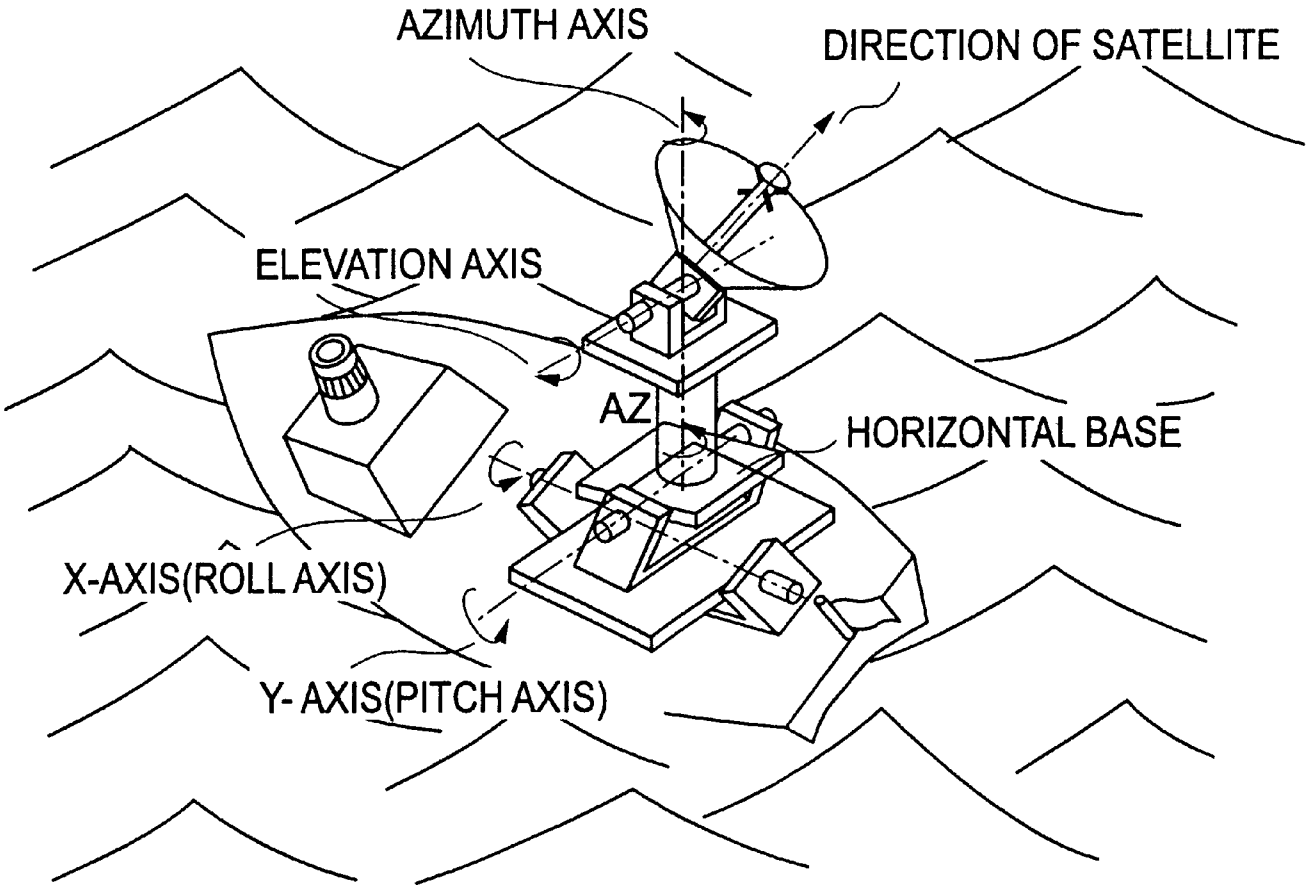
Fig.14 PRIOR ART
FIG. 14 is a conceptual drawing showing the antenna tracking technique of a conventional type small-sized earth station.

Further, for a fourth embodiment of the present invention, an offset Gregorian antenna provided with plural reflectors shown in FIG. 12 may be also used. In this embodiment, a predetermined offset is applied to main reflectors 25 and 26 having a paraboloid so that the maximum antenna gain is obtained at the minimum operational elevation angle. Deputy reflectors 27 and 28 respectively have an ellipsoid of revolution sharing the focus of the paraboloid. The center of each phase of primary feeds 1 and 2 is located in another focus of the ellipsoid of revolution.

According to the constitution described in the above second to fourth embodiments using the antenna provided with plural reflectors, loss in feeding is further reduced, the primary feed is fixed and the height of the whole antenna is further reduced, compared with the antenna in the first embodiment.

As described above, the antenna for communicating with a low earth orbit satellite according to the present invention produces the following effect:

First, the best characteristics can be obtained at the minimum elevation angle at which propagation loss and attenuation by rainfall are the largest in a channel to a satellite by optimizing the side lobe characteristic of the antenna and the cross-polarized electromagnetic radiation isolation because the two offset parabolic antennas in which the maximum gain is obtained at the minimum operational elevation angle are used. Particularly, the above effect is remarkable because a LEO satellite uses a microwave band and a millimeter wave band and attenuation by rainfall is large.

Second, as the primary feed is fixed, a flexible part is not required for a feeder and a waveguide, the structure is simplified and the reliability can be enhanced.

Third, as a part driven for tracking a satellite is only the reflector, driven weight is small, tracking at high speed is enabled and the driving mechanism can be miniaturized and lightened.

Fourth, as the mobile two aperture antennas are used based upon an azimuth axis and an elevation axis, plural LEO satellites on the same orbital plane are sequentially tracked and hand over among the satellites is enabled.

What is claimed is:

1. An antenna system for communicating with low earth orbit satellites used on the side of the ground in a satellite communication system using low earth orbit satellites, comprising:

a supporting part;

first and second offset aperture antennas for mechanical tracking of said low earth orbit satellites, said first and second offset aperture antennas being supported on said supporting part and separated by a predetermined distance;

first and second antenna feed lines for respectively feeding said first and second offset aperture antennas extending away from said supporting part between said first and second offset aperture antennas; and switching means for switching said first and second offset aperture antennas to switch over said low earth orbit satellites.

2. An antenna system for communicating with low earth orbit satellites according to claim 1, wherein:

said mechanical tracking is realized by fixing the respective primary feeds of said first and second offset aperture antennas and respectively turning reflectors based upon an azimuth axis and an elevation axis in the direction of said low earth orbit satellites.

3. An antenna system for communicating with low earth orbit satellites according to claim 1, further comprising:

an RF sending/receiving part connected to said antenna feed lines for switching the antenna feed lines and sending or receiving a high-frequency signal.

4. An antenna system for communicating with low earth orbit satellites according to claim 1, wherein:

the value of said offset is set so that antenna gain is maximum at a predetermined minimum operational elevation angle.

5. An antenna system for communicating with low earth orbit satellites according to claim 4, wherein:

said predetermined minimum operational elevation angle is determined based upon the number of satellites arranged on the same orbital plane as the altitude of said low earth orbit satellite.

6. An antenna system for communicating with low earth orbit satellites according to claim 5, wherein:

a range in which said low earth orbit satellite is tracked from said minimum operational elevation angle to the zenith in the direction of an elevation angle and ranges from 0° to 360° in the direction of an azimuth angle.

7. An antenna system for communicating with low earth orbit satellites according to claim 1, wherein:

each of said first and second offset aperture antennas is an offset parabolic antenna.

8. An antenna system for communicating with low earth orbit satellites according to claim 1, wherein:

each of said first and second offset aperture antennas is an offset Cassegrainian antenna.

9. An antenna system for communicating with low earth orbit satellites according to claim 1, wherein:

each of said first and second offset aperture antennas is an offset Gregorian antenna.

10. An antenna system for communicating with low earth orbit satellites according to claim 1, wherein:

if said minimum operational elevation angle is θ MIN, and a diameter of each of said first and second antenna is D, and Φ is an angle between a reflector of said first and second offset aperture antennas and the horizontal plane, said predetermined distance S is as follows:

$$\Phi=(90^\circ-\theta MIN)/2 \quad (1)$$

$$S=D(\cos\Phi+\sin\Phi/\tan\theta\ \mathrm{MIN}). \quad (2)$$

11. An antenna system for communicating with low earth orbit satellites used on the side of the ground in a satellite communication system using low earth orbit satellites, comprising:

a support;

first and second offset aperture antennas mounted on said support for mechanical tracking of said low earth orbit satellites, said first and second offset aperture antennas being separated by a predetermined distance;

switching means for switching said first and second offset aperture antennas to switch over said low earth orbit satellites;

antenna feed lines for respectively feeding said first and second offset aperture antennas; and an RF sending/receiving part connected to said antenna feed lines for switching the feed lines and sending or receiving a high-frequency signal, wherein:

said antenna feed lines and said RF sending/receiving part are mounted on said support between said first and second offset aperture antennas.

12. An antenna for communicating with a lower earth orbit satellite used on the side of the ground in a satellite communication system using low earth orbit satellites, comprising:

two reflectors the centers of which are separated by predetermined distance and provided with a paraboloid offset as predetermined;

two Az-EL mounts respectively mounting said two reflectors to a support, said two Az-EL mounts for tracking said low earth orbit satellite by respectively turning said reflectors based upon an azimuth axis and an elevation axis;

two primary feeds for radiating predetermined beams on said respective reflectors;

two feed lines for respectively feeding to said primary feeds and respectively supporting said primary feeds so that they can be fixed independent of said reflectors; and an RF sending/receiving part mounted to said support between said two reflectors and connected to said feed lines for selecting either feed line and sending or receiving a high-frequency signal.

13. An antenna system for communicating with low earth orbit satellites used on the side of the ground in a satellite communication system using low earth orbit satellites,0 comprising:

first and second offset aperture antennas for mechanical tracking of said low earth orbit satellites, said first and second offset aperture antennas being separated by a predetermined distance; and switching means for switching said first and second offset aperture antennas to switch over said low earth orbit satellites, wherein said mechanical tracking is realized by fixing the respective primary feeds of said first and second offset aperture antennas and respectively turning reflectors based upon an azimuth axis and an elevation axis in the direction of said low earth orbit satellites, and, wherein:

said azimuth axis turns around a straight line connecting the center of said reflector and the center of said primary feed; and said elevation axis turns around a straight line and comes into contact with the surface of said reflector and perpendicular to a straight line which intersects the axis of the paraboloid including the surface of said reflector.

* * * * *